US007717539B2

(12) United States Patent
Seo

(10) Patent No.: US 7,717,539 B2
(45) Date of Patent: May 18, 2010

(54) APPARATUS AND METHOD FOR COATING POLYIMIDE LAYER

(75) Inventor: Hwang Un Seo, Busan (KR)

(73) Assignee: LG Display Co., Ltd., Seoul (KR)

( * ) Notice: Subject to any disclaimer, the term of this patent is extended or adjusted under 35 U.S.C. 154(b) by 795 days.

(21) Appl. No.: 11/645,731

(22) Filed: Dec. 27, 2006

(65) Prior Publication Data

US 2007/0229579 A1 Oct. 4, 2007

(30) Foreign Application Priority Data

Mar. 29, 2006 (KR) ..... 10-2006-0028389

(51) Int. Cl.
*B41J 2/165* (2006.01)

(52) U.S. Cl. ..... 347/33; 347/28

(58) Field of Classification Search ..... None
See application file for complete search history.

(56) References Cited

U.S. PATENT DOCUMENTS 5,607,732 A * 3/1997 Miyamoto et al. ..... 428/1.26
5,912,054 A 6/1999 Tateyama
6,164,754 A * 12/2000 Ide et al. ..... 347/33
6,726,304 B2 * 4/2004 Fassler et al. ..... 347/28
6,827,619 B2 * 12/2004 Oda et al. ..... 445/6
2005/0122351 A1 * 6/2005 Yamazaki et al. ..... 347/5

FOREIGN PATENT DOCUMENTS

JP 7-89092 A 4/1995
JP 8-150710 A 6/1996
JP 10-76203 A 3/1998
JP 11-123832 A 5/1999
JP 2002-254663 A 9/2002
JP 2003-1835 A 1/2003
JP 2003-136013 A 5/2003

OTHER PUBLICATIONS

Office Action issued Dec. 7, 2009 in corresponding Japanese Application No. 2006-338486.

* cited by examiner

*Primary Examiner*—Stephen D Meier
*Assistant Examiner*—Alexander C Witkowski
(74) *Attorney, Agent, or Firm*—Holland & Knight LLP

(57) ABSTRACT

An apparatus for coating polyimide layer includes a print table for affixing a substrate thereon, an inkjet head installed over the print table and having a jetting surface with a plurality of nozzles for jetting polyimide liquid onto the substrate, a polyimide liquid supply tank for receiving a polyimide liquid therein, a cleaning liquid supply tank for receiving cleaning liquid, a wiper cleaning bar adjacent to the cleaning liquid supply tank, and a wiper movable from one side of the jetting surface to an other side of the jetting surface while the wiper contacts the jetting surface of the inkjet head, and rotatable to dip the wiper into the cleaning liquid and then contact the wiper cleaning bar so as to remove cleaning liquid from the wiper.

20 Claims, 11 Drawing Sheets

APPARATUS AND METHOD FOR COATING POLYIMIDE LAYER

This application claims the benefit of Korean patent application 10-2006-0028389 filed in Korea on Mar. 29, 2006, which is hereby incorporated by reference in its entirety.

BACKGROUND OF THE INVENTION

1. Field of the Invention

Embodiments of the invention relates to coating, and more particularly, to an apparatus and method for coating a polyimide layer.

2. Background of the Related Art

A liquid crystal display (LCD) device is an apparatus for displaying a desired image by adjusting quantity of light reaching a color filter substrate. The adjustment of the quantity of light is accomplished by changing intermolecular orientation of liquid crystal molecules interposed between a transparent insulating substrate serving as the color filter substrate and an array substrate. One type of LCD device is a thin film transistor liquid crystal display (TFT LCD) device, which uses thin film transistors (TFTs) as switching elements.

In general, an LCD device includes an LCD panel for displaying an image and a driver for driving the LCD panel by applying driving signals to the LCD panel. The LCD panel includes a color filter substrate and an array substrate bonded to each other with a predetermined gap therebetween. A layer of liquid crystal molecules is in the gap between the color filter substrate and the array substrate. The color filter substrate and the array substrate of the LCD panel are manufactured through a plurality of masking processes. Polyimide layers are formed on respective substrates after finishing the masking processes and before the substrates are bonded to each other. The polyimide layers are used as alignment films to arrange the liquid crystal molecules in a predetermined direction.

The polyimide layers can be coated on the substrates through a variety of methods, such as a spin-coating method, a spray-coating method, and an inkjet-coating method. Of the coating methods, the inkjet-coating method is the quickest and easiest to apply because of the use of an inkjet coating apparatus. A plurality of inkjet heads are used in an inkjet coating apparatus to jet polyimide liquid onto the substrates.

FIG. 1A and FIG. 1B are schematic views illustrating an accumulation problem in an apparatus for coating a polyimide layer according to the related art. More specifically, FIG. 1A and FIG. 1B are schematic views illustrating the surface flatness of the inkjet head 10 before and after jetting polyimide liquid onto the substrates in the inkjet-coating method according to the related art. The inkjet head 10 moves in a predetermined direction above a print table on which a target substrate is placed while jetting polyimide liquid onto the target substrate, thereby coating a polyimide layer onto the substrate. As shown in FIG. 1A, when the jetting surface of the inkjet head 10 is clean and does not have any residue thereon, polyimide liquid can be jetted uniformly so that a polyimide layer having uniform thickness can be formed on the substrate. However, as shown in FIG. 1B, polyimide liquid residue can accumulate on the jetting surface A1 of the inkjet head 10 even after only one inkjet coating process.

The accumulated polyimide liquid residue on the jetting surface of the inkjet head 10 interferes with jetting of the polyimide liquid during a subsequent inkjet coating process. Thus, a non-uniform polyimide layer may be coated on a substrate or, in extreme cases, no polyimide layer is coated on a substrate. The non-uniform polyimide layer can include pinhole faults and/or line blemishes. Even if the jetting surface of the inkjet head is cleaned using a cleaning bar, polyimide residue may still remain on the inkjet head.

SUMMARY OF THE INVENTION

Accordingly, embodiments of the invention is directed to an apparatus and method for coating a polyimide layer that substantially obviates one or more of the problems due to limitations and disadvantages of the related art.

An object of embodiments of the invention is to provide an apparatus and method for coating a polyimide layer that includes the capability of effectively removing polyimide residue from the jetting surface of an inkjet head.

Another object of embodiments of the invention is to provide an apparatus and method for coating a polyimide layer that prevents pinhole faults and line blemishes from occurring in the polyimide layer.

Additional features and advantages of embodiments of the invention will be set forth in the description which follows, and in part will be apparent from the description, or may be learned by practice of embodiments of the invention. The objectives and other advantages of the embodiments of the invention will be realized and attained by the structure particularly pointed out in the written description and claims hereof as well as the appended drawings.

According to one aspect of embodiments of the invention, there is provided an apparatus for coating polyimide layer includes a print table for affixing a substrate thereon, an inkjet head installed over the print table and having a jetting surface with a plurality of nozzles for jetting polyimide liquid onto the substrate, a polyimide liquid supply tank for receiving a polyimide liquid therein, a cleaning liquid supply tank for receiving cleaning liquid, a wiper cleaning bar adjacent to the cleaning liquid supply tank, and a wiper movable from one side of the jetting surface to an other side of the jetting surface while the wiper contacts the jetting surface of the inkjet head, and rotatable to dip the wiper into the cleaning liquid and then contact the wiper cleaning bar so as to remove cleaning liquid from the wiper.

In another aspect of embodiments of the invention, there is provided method for coating polyimide layer that includes placing a substrate on a print table, loading polyimide liquid into a polyimide liquid supply tank, loading a cleaning liquid vessel filled with cleaning liquid into a cleaning liquid supply tank, jetting the polyimide liquid onto the substrate through a plurality of nozzles provided in the jetting surface of the inkjet head after the polyimide liquid is supplied to the inkjet head installed over the print table, wiping off the jetting surface with a wiper, dipping the wiper into the cleaning liquid, and removing the cleaning liquid remaining on the wiper with a wiper cleaning bar.

In yet another aspect of embodiments of the invention, a method for coating polyimide layer includes wiping off a jetting surface of an inkjet head after polyimide liquid is jetted from the inkjet head with a wiper, dipping the wiper into the cleaning liquid, rotating the wiper into a first direction so as to dip the wiper into the cleaning liquid, and rotating the wiper further in the first direction such that the wiper contacts the wiper cleaning bar.

It is to be understood that both the foregoing general description and the following detailed description are exemplary and explanatory and are intended to provide further explanation of embodiments of the invention as claimed.

BRIEF DESCRIPTION OF THE DRAWINGS

The accompanying drawings, which are included to provide a further understanding of embodiments of the invention and are incorporated in and constitute a part of this specification, illustrate embodiments of the invention and together with the description serve to explain the principles of embodiments of the invention. In the drawings.

DETAILED DESCRIPTION OF THE PREFERRED EMBODIMENTS

Figure 1A:
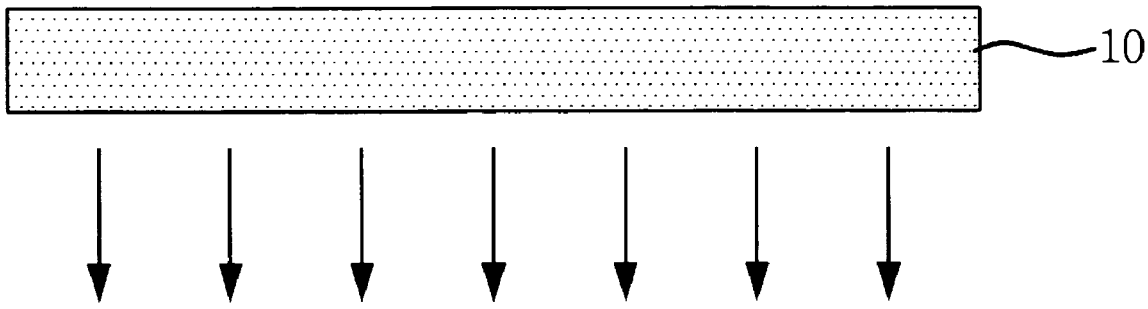
FIG. 1A (Related Art)
FIG. 1A and FIG. 1B are schematic views illustrating an accumulation problem in an apparatus for coating a polyimide layer according to the related art.
Figure 1B:
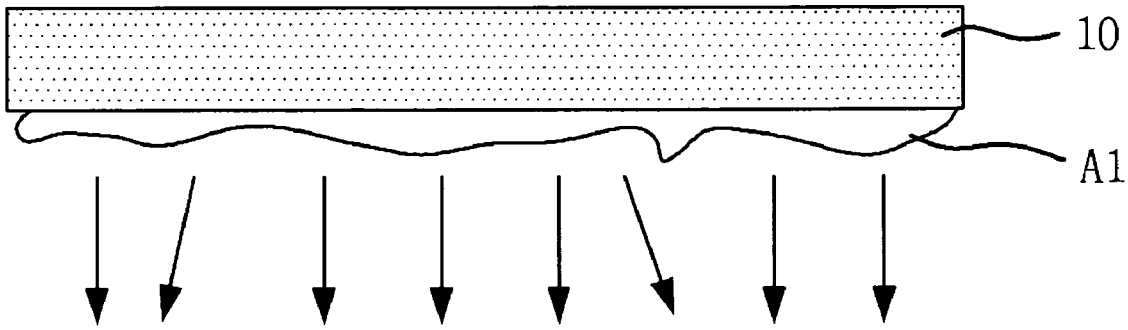
FIG. 1B (Related Art)

Reference will now be made in detail to the preferred embodiments of the invention, examples of which are illustrated in the accompanying drawings. The invention may, however, be embodied in many different forms and should not be construed as being limited to the embodiments set forth herein; rather, these embodiments are provided so that this disclosure will be thorough and complete, and will fully convey the concept of the invention to those skilled in the art. In the drawings, the thicknesses of layers and regions are exaggerated for clarity. Like reference numerals in the drawings denote like elements.

Figure 2:
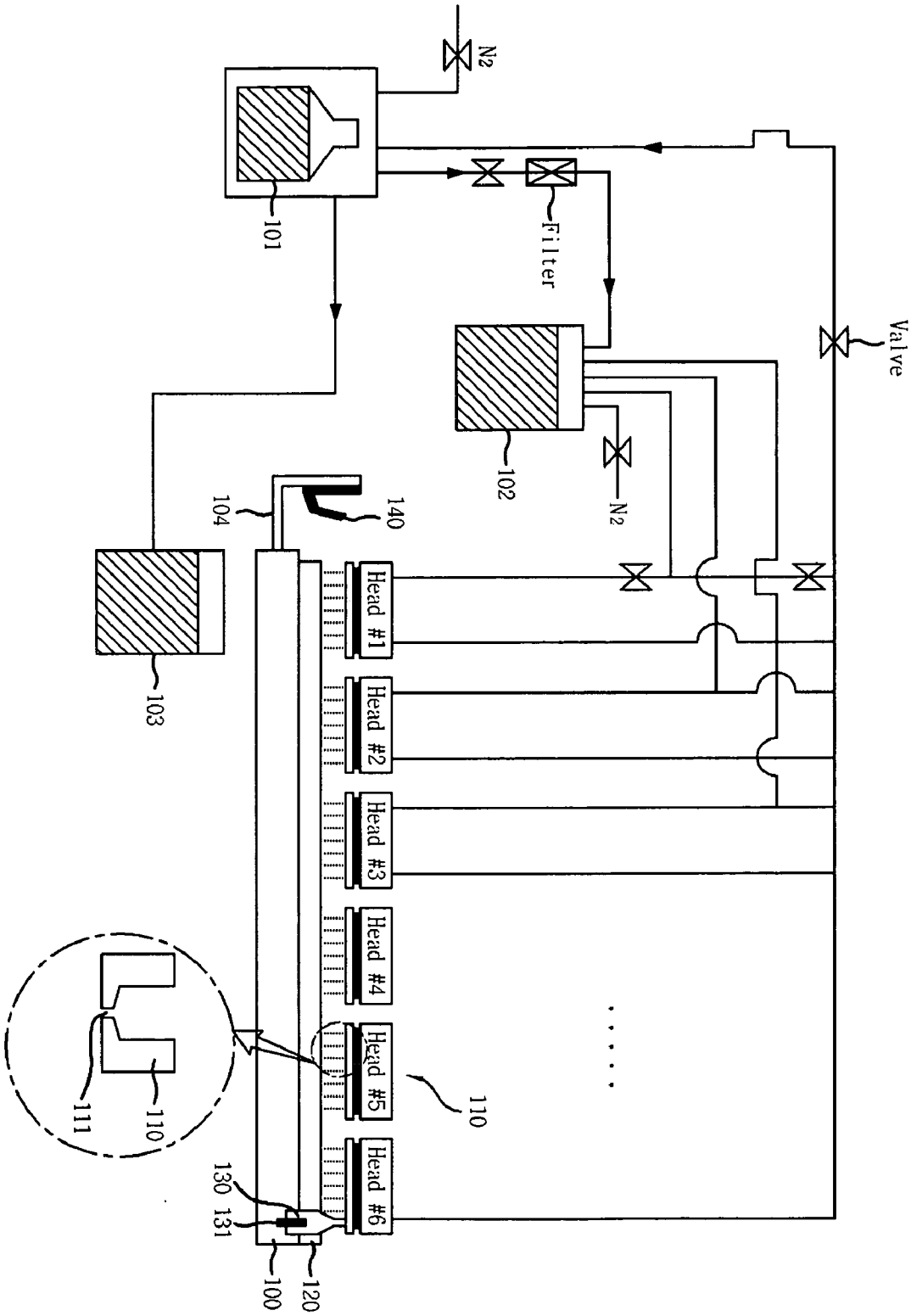
FIG. 2 is a schematic diagram illustrating an apparatus for coating a polyimide layer according to an embodiment of the invention.

FIG. 2 illustrates constitution of an apparatus for coating a polyimide layer according to an embodiment of the invention. As shown in FIG. 2, the apparatus for coating a polyimide layer according to an embodiment of the invention includes a print table 100, an inkjet head 110, a polyimide liquid supply tank 102, and a wiper 130. More specifically, the polyimide layer coating apparatus has the print table 100 on which the substrate 120 to be coated with a polyimide layer is placed and fixed. The substrate 120 can either be a color filter substrate or a thin film transistor array substrate of an LCD device.

A plurality of inkjet heads 110 are arranged in parallel with each other over the substrate 120, and each inkjet head 110 is connected to the polyimide liquid supply tank 102. The polyimide liquid supply tank 102 receives polyimide liquid from a pressure tank 101, and supplies the polyimide liquid to the inkjet head 110 at a predetermined constant pressure and flow rate. Polyimide liquid has the advantage of being heat resistant, chemically stable and high reliability.

A gas connection pipe provides nitrogen ($N_2$) to the pressure tank 101. A polyimide liquid recovery connection pipe provides polyimide liquid recovered from the inkjet head to the pressure tank 101. A polyimide supply connection pipe through which polyimide liquid is provided to the polyimide supply tank 102 through a filter is connected to the pressure tank 101. A back pressure supply connection pipe for providing back pressure to a cleaning liquid supply tank 103 is also connected to the pressure tank 101. Further, each connection pipe is provided with a valve for controlling amount of the content passing through the connection pipes and the pressure in the connection pipes.

A jetting surface of each inkjet head 110, which faces the substrate 120, is provided with a plurality of nozzles 111 for jetting the polyimide liquid therethrough. The inkjet head 110 scans over the substrate 120 while jetting the polyimide liquid onto the substrate 120, thereby forming a polyimide layer on the substrate 120. After jetting the polyimide layer onto the substrate, the jetting surface of the inkjet head 110 is wet with the polyimide liquid. The polyimide liquid remaining on the jetting surface of the inkjet head 110 is then removed through a wiping method. Accordingly, the jetting surface of the inkjet head is maintained in a state such that polyimide liquid can be jetted uniformly.

The wiper 130 is installed in a manner such that it can move along a moving shaft 131 while the wiper 130 maintains contact with the jetting surfaces of the inkjet 110, so that the wiper 130 can perform a wiping operation. After finishing the wiping operation, the wiper 130 rotates 180 degrees from a wiping position so as to be dipped into a cleaning liquid in the cleaning liquid supply tank 103, and then further rotates another 180 degrees to go back to the wiping position. While returning to the wiping position, the wiper 130 comes into contact with the wiper cleaning bar 140. Thus, polyimide liquid residue on the wiper 130 is removed as the wiper 130 is dipped into the cleaning liquid, and then any remaining polyimide and/or cleaning liquid on the wiper 130 is removed as the wiper 130 moves past the wiper cleaning bar 140. Further, the wiper 130 can be dipped and wiped again before another wiping operation.

If polyimide liquid and cleaning liquid still remain on the surface of wiper 130 after the cleaning of the wiper, the wiping operation of the inkjet head 110 cannot be properly performed. For example, if the wiping operation is not properly performed, polyimide liquid may be partially jetted, non-uniformly jetted or not jetted at all. Such problems are prevented by dipping the wiper 130 into the cleaning liquid and then having the wiper 130 contact the wiper cleaning bar 140. The cleaning liquid supply tank 103 receives a cleaning liquid vessel filled with cleaning liquid and supplies the cleaning liquid when cleaning the wiper 130. The cleaning liquid can be an imide-based polar solvent N-Methyl pyrrolidone (NMP). The wiper cleaning bar 140 is installed in such a manner that the wiper cleaning bar 140 can come into contact with the surface of the wiper 130 after the wiper 130 is dipped into the cleaning liquid so that the wiper cleaning bar 140 removes cleaning liquid and any remaining polyimide from the surface of the wiper 130.

The polyimide liquid supply tank 102 and the cleaning liquid supply tank 103 can be structured such that they respectively receive the polyimide liquid in a polyimide liquid filled vessel and a cleaning liquid filled vessel, which expel their contents in response to an external gas pressure. Accordingly, the polyimide liquid supply tank 102 and the cleaning liquid supply tank 103 can be a single tank that receives both the polyimide liquid vessel and the cleaning liquid vessel. In other words, the polyimide liquid vessel and the cleaning liquid vessel share a single tank.

Figure 3A:
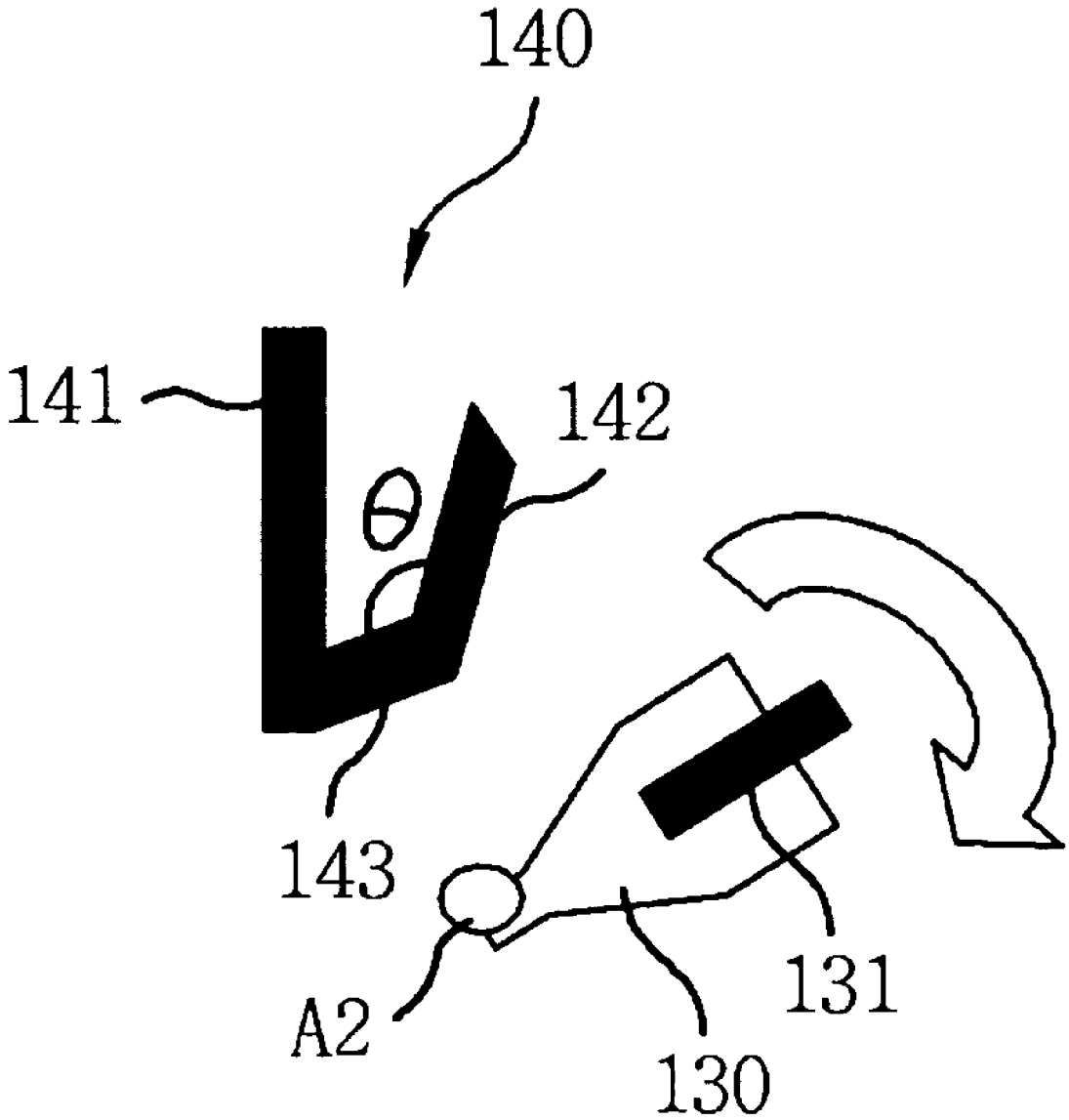
FIG. 3A through FIG. 3C are schematic views for showing operational movement of a wiper with respect to a wiper cleaning bar.
Figure 3B:
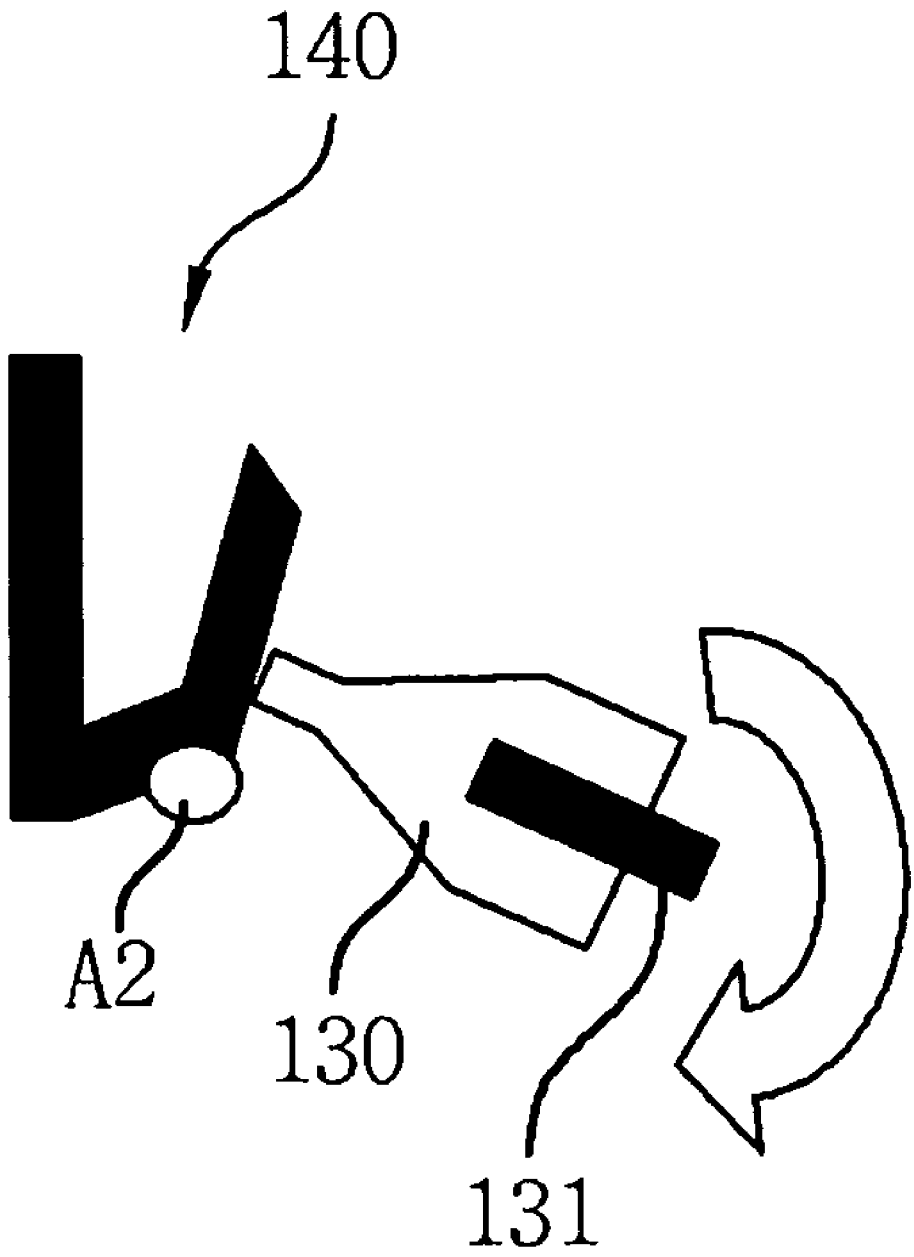
Figure 3C:
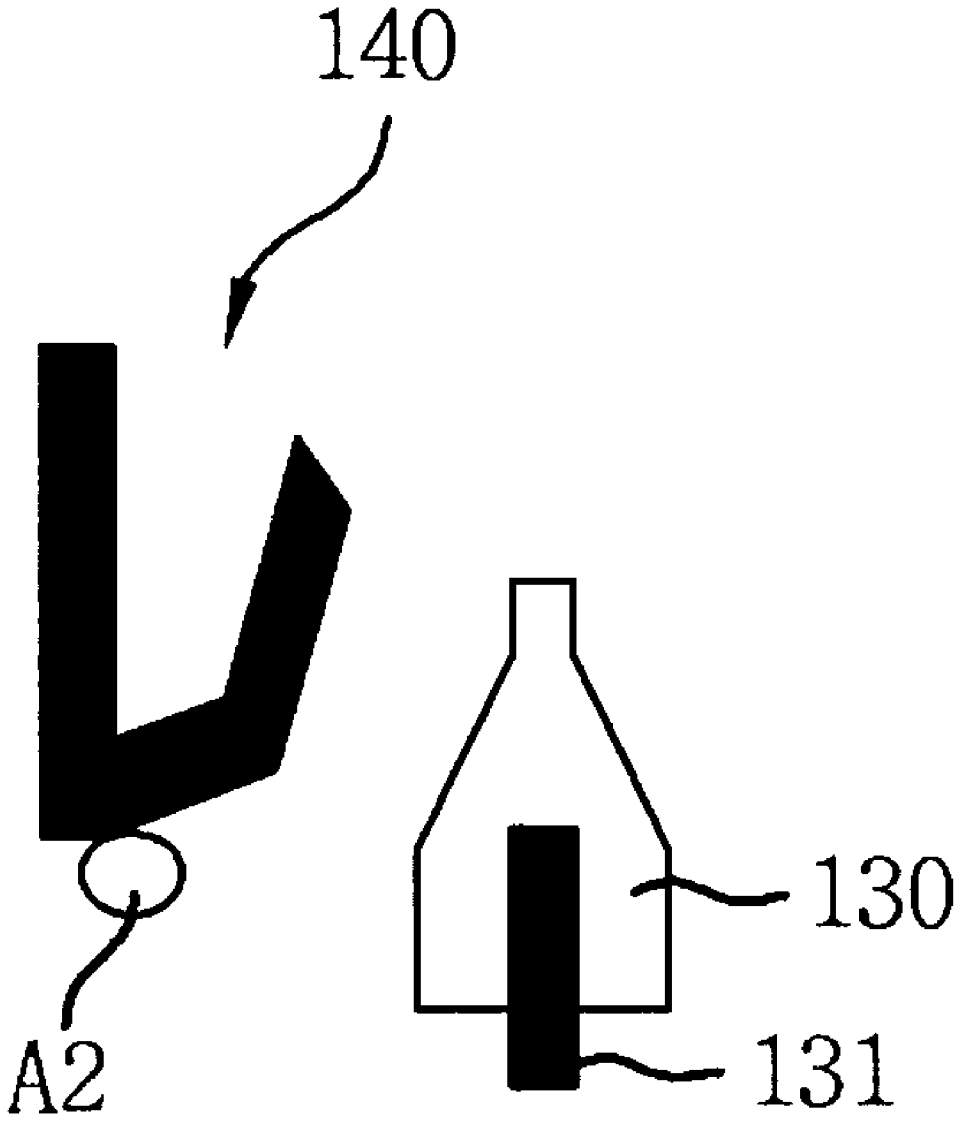

FIG. 3A through FIG. 3C are schematic views for showing operational movement of a wiper with respect to a wiper cleaning bar. FIG. 3A through FIG. 3C illustrate the process sequence in which the wiper 130 is cleaned using the cleaning liquid, and then residue on the wiper 130 is removed as the wiper 130 rotates on a moving shaft 131 so that the wiper 130 contacts the wiper cleaning bar 140. Referring to FIG. 3A, the cleaning bar 140 includes a vertical support 141 affixed to the support 104, a first cleaning structure 143 attached to the vertical support 141 and having an inclined surface facing the wiper 130, and a second cleaning structure 143 attached to the first cleaning structure 143 and having another inclined surface facing the wiper 130. When the wiper 130 is rotated in a first direction from an initial position, the wiper 130 is dipped into the cleaning liquid. When the wiper 130 is then further rotated in the first direction, the wiper 130 contacts the wiper cleaning bar 140 as the wiper 130 is returned to its initial position.

Referring to FIG. 3A through FIG. 3C, the first rotation in which the wiper 130 rotates to a cleaning position so that the wiper 130 dipped into the cleaning liquid is done in a clockwise direction when the upper surface of the wiper 130 goes from contacting the jetting surface of the inkjet head 110 to being dipped into cleaning liquid. When the wiper 130 is further rotated in the clockwise direction, the wiper 130 contacts the wiper cleaning bar 140 and then the upper surface of the wiper 130 contacts the jetting surface of the inkjet head 110. The wiper cleaning bar 140 is configured so as to minimize a frictional force between the wiper 130 and the wiper cleaning bar 140 when the wiper 130 comes into contact with the wiper cleaning bar 140 by rotation of the wiper 130. To minimize the frictional force between the wiper 130 and the wiper cleaning bar 140, the first cleaning structure 142 has an angle θ in a range of 90 to 140 degrees with respect to the second cleaning structure 143. The wiper cleaning bar 140 may be made of stainless steel, aluminum, carbon graphite, carbon steel, cast iron, Ethylene Propylene Dien Rubber (EPDM), Polytrafluore Ethylene (PTEE) or Fluorocarbon (FKM).

Figure 4:
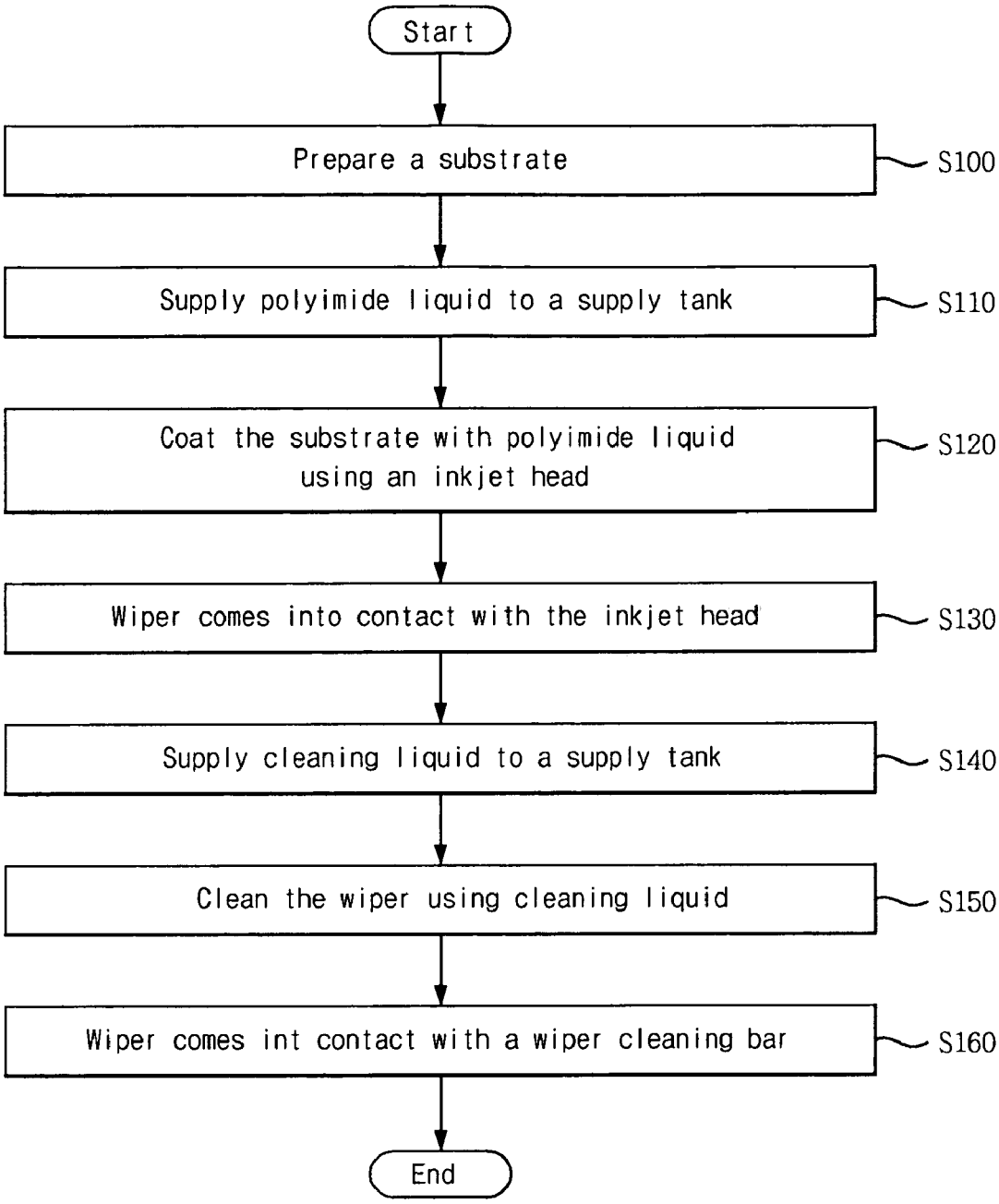
FIG. 4 is a flow chart showing a method of coating a polyimide layer according to another embodiment of the invention.
Figure 5:
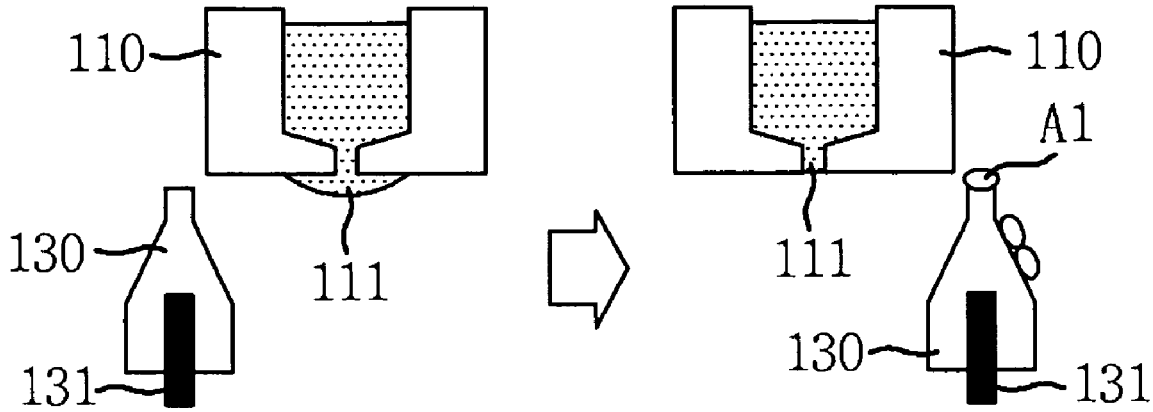
FIG. 5 shows a process for wiping an inkjet head in accordance with the process step of FIG. 4.

FIG. 4 is a flow chart illustrating the method for coating a polyimide layer according to another embodiment of the invention, and FIG. 5 shows a process for wiping an inkjet head in accordance with the process step of FIG. 4, FIGS. 6A-6C shows a process for cleaning a wiper in accordance with the process steps of FIG. 4.

As described in step 100 of FIG. 4, a substrate 120 is positioned and affixed to the print table 100. The substrate 120 may be a thin film transistor array substrate or a color filter substrate of an LCD device.

Next, a polyimide liquid vessel filled with polyimide liquid is loaded into the polyimide liquid supply tank 102, as described in steps S110 and S120 of FIG. 4. Subsequently, the polyimide liquid is supplied to the inkjet head 110 installed over the print table 100, and then jetted on the substrate 120 through the nozzles 111 provided on the jetting surface of the inkjet 110.

Next, referring to FIG. 5, the wiper 130 moves to contact the jetting surface of the inkjet 110 and wipes off the nozzles 111 of the inkjet head 110 in a wiping operation, as described in step S130 of FIG. 4. After finishing the wiping operation, polyimide liquid residue A1 may remain on the wiper 130.

Figure 6A:
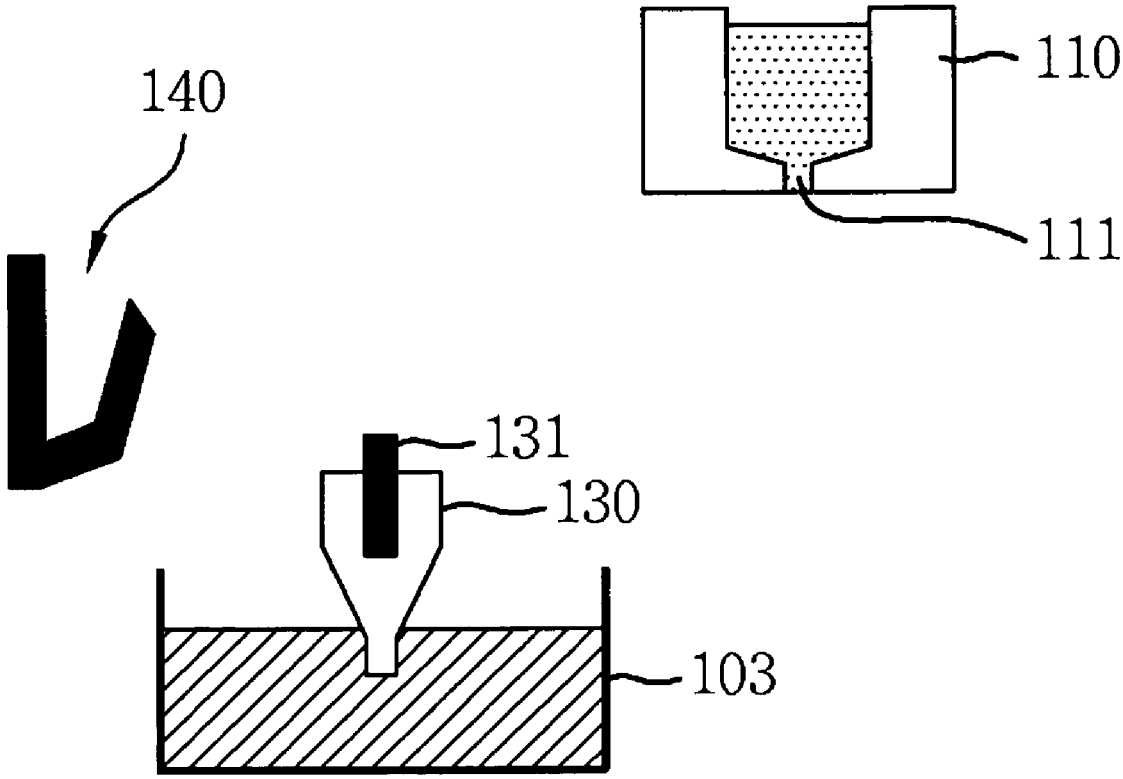
FIGS. 6A-6C shows a process for cleaning a wiper in accordance with the process steps of FIG. 4.

Next, as described in steps S140 and S150 of FIG. 4, a cleaning liquid vessel filled with cleaning liquid is loaded into the cleaning liquid supply tank, and then the wiper 130 rotates from an initial position, as shown in FIG. 6A, to dip into the cleaning liquid so that the wiper 130 is cleaned. The cleaning liquid can be N-Methyl pyrrolidone imide-based polar solvent to remove both cured and un-cured polyimide liquid.

As described in step S160 of FIG. 4, the wiper 130 rotates so as to come into contact with the wiper cleaning bar 140 so that polyimide liquid residue and/or any cleaning liquid remaining on the wiper 130 can be removed and then the wiper 130 further rotates to return to the initial position.

Figure 6B:
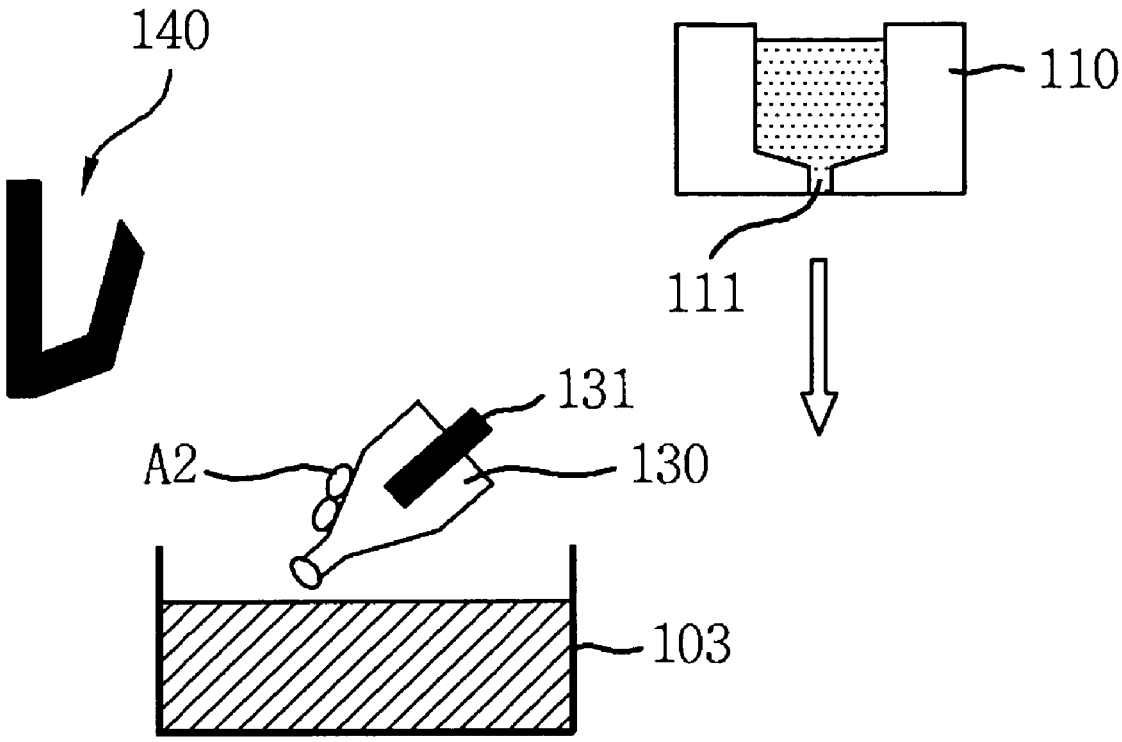
Figure 6C:
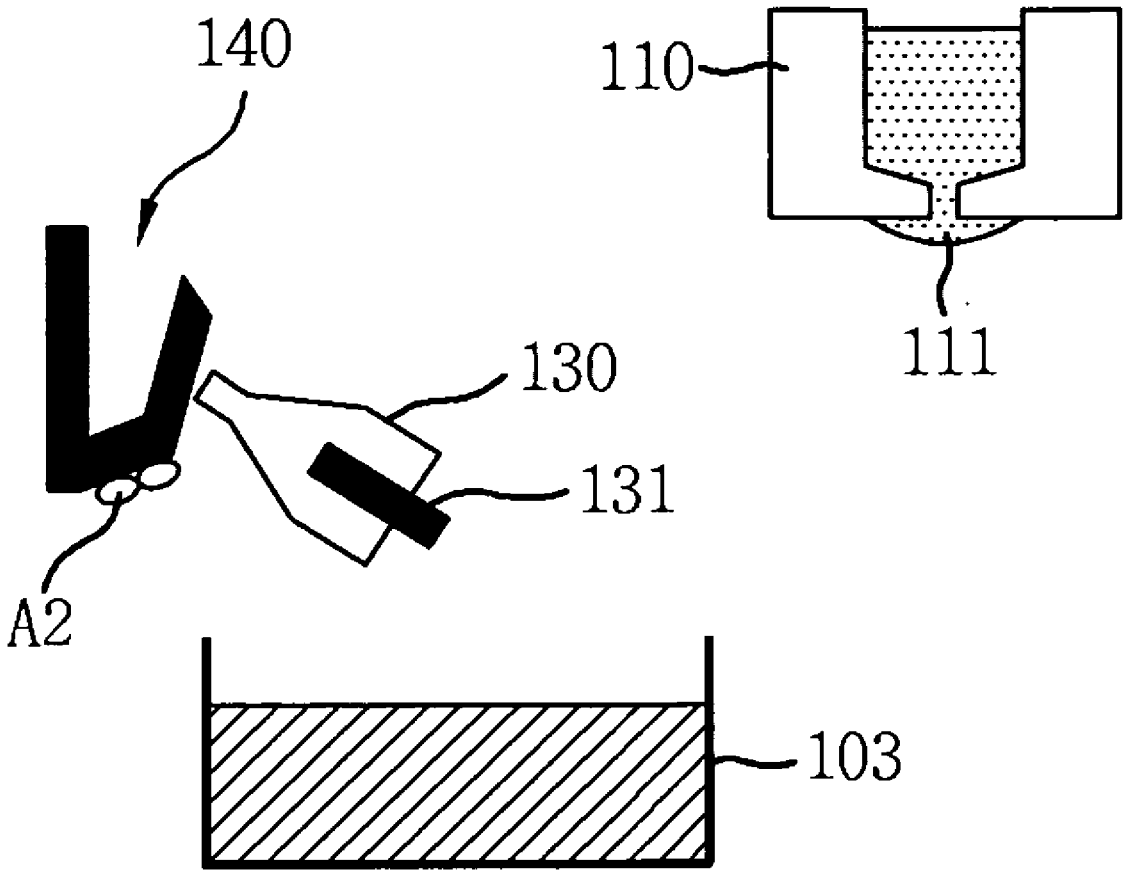

FIG. 6B and FIG. 6C illustrate respective conditions of the wiper 130 before and after performing the step S160, as described in FIG. 4. As shown in FIG. 6A and FIG. 6B, the cleaning liquid and the polyimide liquid residue A2 remaining on the wiper 130 are removed when the wiper 130 comes into contact with the wiper cleaning bar 140, so that a clean wiper 130 can be subsequently used to wipe off the inkjet head 110.

As described above, the wiper 130 rotates in a first direction from an initial position to dip into then cleaning liquid, and then rotates further in the first direction back to the initial position after coming into contact with the wiper cleaning bar 140 to remove cleaning liquid from the wiper 30. Thus, the inkjet head 110 of the polyimide layer coating apparatus can then be wiped off with a clean wiper 130 because the wiper cleaning bar 140 keeps the wiper 130 clean such that polyimide liquid residue remaining on the inkjet head 110 can be effectively removed. The polyimide layer coating apparatus and method according to embodiments of the invention can reduce pinhole faults and line blemishes by effectively removing polyimide liquid residue on the surface of inkjet when forming a polyimide layer through an inkjet coating method.

What is claimed is:

1. An apparatus for coating polyimide layer, comprising:

a print table for affixing a substrate thereon;

an inkjet head installed over the print table and having a jetting surface with a plurality of nozzles for jetting polyimide liquid onto the substrate;

a polyimide liquid supply tank for receiving a polyimide liquid therein;

a cleaning liquid supply tank for receiving cleaning liquid;

a wiper cleaning bar adjacent to the cleaning liquid supply tank; and a wiper linearly movable from one side of the jetting surface to an other side of the jetting surface while the wiper contacts the jetting surface of the inkjet head, and rotatable to dip the wiper into the cleaning liquid and then contact the wiper cleaning bar so as to remove cleaning liquid from the wiper.

2. The apparatus for coating polyimide layer according to claim 1, wherein the wiper is dipped into the cleaning liquid when rotated in a first direction from an initial position.

3. The apparatus for coating polyimide layer according to claim 2, wherein the wiper contacts the wiper cleaning bar when further rotated in the first direction.

4. The apparatus for coating polyimide layer according to claim 1, wherein the cleaning bar includes:

a vertical support affixed to a support;

a first cleaning structure attached to the vertical support and having a first contact surface facing the wiper; and a second cleaning structure attached to the first contact structure and having a second contact surface facing the wiper.

5. The apparatus for coating polyimide layer according to claim 4, wherein the first cleaning structure has an angle within a range from about 90 to about 140 degrees with respect to the second cleaning structure.

6. The apparatus for coating polyimide layer according to claim 1, wherein the wiper cleaning bar is made of one of stainless steel, aluminum, carbon graphite, carbon steel, cast iron, ethylene propylene dien rubber, polytrafluore ethylene, and fluorocarbon.

7. The apparatus for coating polyimide layer according to claim 1, wherein the cleaning liquid includes N-methyl pyrrolidone.

8. The apparatus for coating polyimide layer according to claim 1, wherein the polyimide supply tank and the cleaning liquid supply tank share a single tank.

9. A method for coating polyimide layer, comprising:

placing a substrate on a print table;

loading polyimide liquid into a polyimide liquid supply tank;

loading a cleaning liquid vessel filled with cleaning liquid into a cleaning liquid supply tank;

jetting the polyimide liquid onto the substrate through a plurality of nozzles provided in the jetting surface of the inkjet head after the polyimide liquid is supplied to the inkjet head installed over the print table;

wiping off the jetting surface with a wiper by linearly moving the wiper from one side of the jetting surface to an other side of the jetting surface while the wiper contacts the jetting surface of the inkjet head;

dipping the wiper into the cleaning liquid by rotating the wiper; and removing the cleaning liquid remaining on the wiper with a wiper cleaning bar.

10. The method for coating polyimide layer according to claim 9, wherein the dipping the wiper into the cleaning liquid includes rotating the wiper into a first direction so as to dip the wiper into the cleaning liquid.

11. The method for coating polyimide layer according to claim 9, wherein the removing the cleaning liquid remaining on the wiper includes rotating the wiper further in the first direction such that the wiper contacts the wiper cleaning bar.

12. The method for coating polyimide layer according to claim 9, wherein the wiper cleaning bar includes:

a vertical support affixed to a support;

a first cleaning structure attached to the vertical support and having a first contact surface facing the wiper; and a second cleaning structure attached to the first contact structure and having a second contact surface facing the wiper.

13. The method for coating polyimide layer according to claim 12, wherein the first cleaning structure has an angle θ in a range of about 90 to about 140 degrees with respect to the second cleaning structure to minimize a frictional force between the wiper and the wiper cleaning bar.

14. The method for coating polyimide layer according to claim 12, wherein the removing the cleaning liquid remaining on the wiper with a wiper cleaning bar includes the wiper contacting the first and second contact surfaces.

15. The method for coating polyimide layer according to claim 9, wherein the wiper cleaning bar is made of stainless steel, aluminum, carbon graphite, carbon steel, cast iron, ethylene propylene dien rubber, polytrafluore ethylene or fluorocarbon.

16. The method for coating polyimide layer according to claim 9, wherein the cleaning liquid contains N-methyl pyrrolidone.

17. A method for coating polyimide layer, comprising:

wiping off a jetting surface of an inkjet head after polyimide liquid is jetted from the inkjet head with a wiper by linearly moving the wiper from one side of the jetting surface to an other side of the jetting surface while the wiper contacts the jetting surface of the inkjet head;

dipping the wiper into the cleaning liquid;

rotating the wiper into a first direction so as to dip the wiper into the cleaning liquid; and rotating the wiper further in the first direction such that the wiper contacts the wiper cleaning bar.

18. The method for coating polyimide layer according to claim 17, wherein the wiper cleaning bar includes:

a vertical support affixed to a support;

a first cleaning structure attached to the vertical support and having a first contact surface facing the wiper; and a second cleaning structure attached to the first contact structure and having a second contact surface facing the wiper.

19. The method for coating polyimide layer according to claim 18, wherein the first cleaning structure has an angle θ in a range of about 90 to about 140 degrees with respect to the second cleaning structure to minimize a frictional force between the wiper and the wiper cleaning bar.

20. The method for coating polyimide layer according to claim 18, wherein the rotating the wiper further in the first direction such that the wiper contacts the wiper cleaning bar includes the wiper contacting the first and second contact surfaces.

* * * * *